United States Patent [19]

Heimovics, Jr. et al.

[11] Patent Number: 4,460,343

[45] Date of Patent: Jul. 17, 1984

[54] INFLATABLE CONTAINER PACKING SYSTEM

[75] Inventors: John F. Heimovics, Jr., Akron; Paul G. Tritt, Norton, both of Ohio

[73] Assignee: The B. F. Goodrich Company, New York, N.Y.

[21] Appl. No.: 363,185

[22] Filed: Mar. 29, 1982

[51] Int. Cl.[3] ..... B63C 9/02; B63C 9/04

[52] U.S. Cl. ..... 441/40; 52/2; 182/48; 193/25 B; 244/137 P; 244/DIG. 2; 441/42

[58] Field of Search ..... 441/40–42; 244/DIG. 2, 137 P; 52/2; 220/203, 206, 231; 137/526, 539; 193/25 B; 182/48

[56] References Cited

U.S. PATENT DOCUMENTS

| | | | |
|---|---|---|---|
| 2,612,237 | 9/1952 | Tear | 137/539 X |
| 3,166,799 | 1/1965 | Birnkrant | 52/2 X |
| 3,297,049 | 1/1967 | Moskovitz | 137/539 X |
| 3,863,671 | 2/1975 | Heimann | 137/526 |
| 4,368,009 | 1/1983 | Heimovics, Jr. | 417/191 |

*Primary Examiner*—Sherman D. Basinger
*Attorney, Agent, or Firm*—M. J. Colitz, Jr.

[57] ABSTRACT

The container (12) has an inflation opening (46) which is closed by a valve (56) with seals (66) compressed by spring (90) pressure during the packing process. Air is removed from the container (12) for deflation by a vacuum pump (20) and excessive vacuum necessary for deflating the container (12) in a reasonable time but which is too high for the packing process and may damage the valve (56) or seals (66) is limited by a vacuum control unit (20) adjusted to maintain the vacuum below a predetermined vacuum and then admit atmospheric air over that level. The vacuum control unit (20) may have a screw adjustment (34) engageable with a spring (36) for increasing or decreasing pressure on an inlet valve member (32).

3 Claims, 3 Drawing Figures

INFLATABLE CONTAINER PACKING SYSTEM

BACKGROUND OF THE INVENTION

This invention relates to a system for packing inflatable, foldable products such as evacuation slides and life rafts in a very limited space. It has been the practice to pull a sufficient vacuum on the inflatable products to provide for deflation in a reasonable time. This vacuum is greater than that desired for packing of the inflatable products and with escape slides having aspirator flapper valves, the valve seal may be distorted by excessive vacuum in the slide. This can result in malfunctioning of the flapper valve in operation and leakage of air from the slide after inflation especially when it is in the water and being used as a raft.

SUMMARY OF THE INVENTION

According to this invention, the vacuum for removing air from the inflatable escape slide is great enough for deflating the slide and then is limited to less than a predetermined amount for ease of packing and so that the flapper valve seal is not damaged.

More specifically, the present invention provides a packing system for an inflatable, foldable container comprising vacuum means for removing a gaseous medium from said container during deflation and vacuum control means in communication with said vacuum means for admitting air at atmospheric pressure into said container at a predetermined vacuum to facilitate packing of the container in a limited space.

PRESENTLY PREFERRED EMBODIMENT

Figure 2:
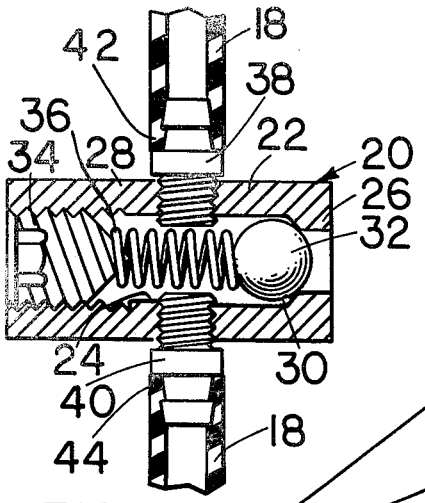
FIG. 2 is an enlarged sectional view of the vacuum control valve taken along line 2—2 in FIG. 1.
Figure 1:
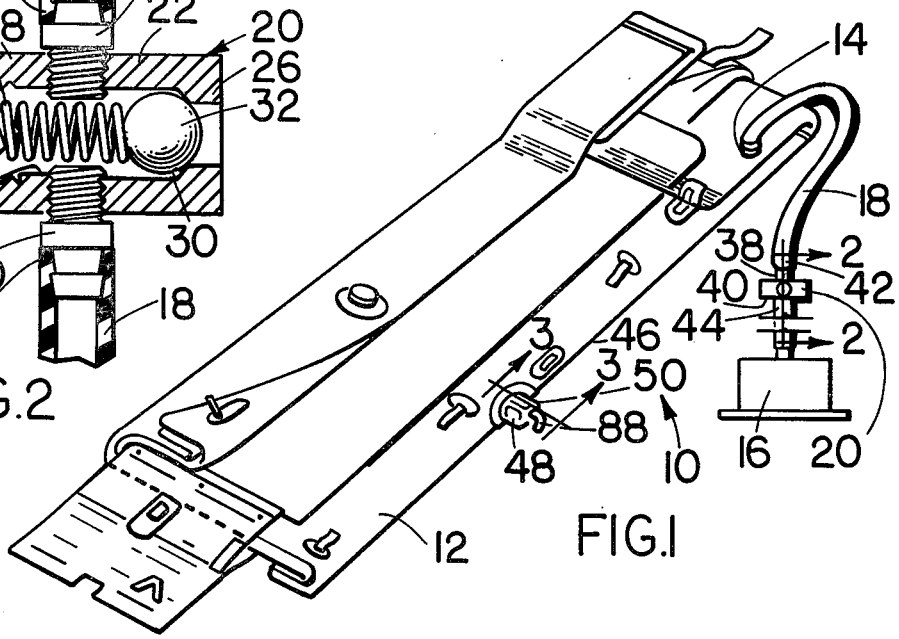
FIG. 1 is a perspective view of a partially packed escape slide during the packing process illustrating the packing system embodying this invention.

Referring to FIG. 1, a packing system 10 embodying the invention is shown including an inflatable, foldable container such as an aircraft escape slide 12 in the deflated, partially packed, condition. The slide 12 has a vacuum opening 14 connected to a suitable vacuum producing means such as a vacuum pump 16 by a conduit or vacuum line 18. Interposed between the vacuum pump 16 and vacuum opening 14 is a vacuum control means such as a vacuum limiter 20 shown in greater detail in FIG. 2.

The vacuum limiter 20 has a casing 22 which may have a cylindrical bore 24 with an inlet end 26 and an adjusting end 28. The inlet end 26 contains a valve seat 30 for receiving a ball 32 for closing the bore 24 to control the passage of air into the bore. An adjusting screw 34 is threaded in the adjusting end 28 of the bore 24 and a spring 36 is interposed between the screw and the ball 32. The adjusting screw 34 may be turned for increasing or decreasing the pressure of the spring 36 against the ball 32. Communication between the vacuum line 18 and the bore 24 is provided by nipples 38 and 40 threaded in holes along the casing 22 and inserted in the ends 42 and 44 of the vacuum line.

The slide 12 has an inflation opening 46 in which an inflating means such as aspirator 48 is mounted. The aspirator 48 may be of the type shown and described in copending patent application Ser. No. 178,430 filed Aug. 15, 1980, now U.S. Pat. No. 4,368,009, which is assigned to the assignee of this application. As shown more clearly in FIG. 3, the aspirator 48 has a tubular housing 50 with an upstream portion 52 of substantially rectangular cross section converging to a downstream portion 54 of substantially circular cross section. In typical installations, all or a substantial portion of the housing 50 extends into the slide 12 through the inflation opening 46.

The end of the upstream portion 52 of housing 50 defines an inlet to the aspirator 48 while the end (not shown) of the downstream portion 54 defines an outlet. Air from the atmosphere entering the inlet to the aspirator 48 flows through the aspirator and into the inflatable chamber of the escape slide 12.

A valve assembly, generally referenced 56, controls airflow into the aspirator 48 and includes an inlet or valve plate 58 having a flange 60 extending around generally rectangular openings in the plate. A pair of flapper plates 62 are hingedly mounted on the upstream portion 52 of the aspirator 48 by hinge members 64 so that each of the plates will open in an inward or downstream direction swinging away from each other toward opposing walls of the upstream portion to the position illustrated by the dot-dash lines in FIG. 3. Each of the flapper plates 62 has a sealing member such as a rubber sealing lip 66 extending along the margins of the upstream or outer surfaces of the plates.

An inlet adapter 68 is mounted centrally of the valve plate 58 and is connected by a cylindrical member 70 to a nozzle assembly 72 extending further downstream within the aspirator 48. The nozzle assembly 72 has a plurality of spaced jets 74 through which the high pressure gas is directed during the inflation of the escape slide 12. Slidably mounted around the cylindrical member 70 is a cylindrical locking sleeve 76 having an annular projection 78 in sliding contact with the outer surface of the cylindrical member and defining an annular chamber 80 with a retaining ring 82 fixedly mounted over the cylindrical member and inlet adapter 68. An inlet port 84 in the cylindrical member 70 provides for communication between the annular chamber 80 and a gas transfer chamber 86. A swivel fitting 88 is mounted on the inlet adapter 68 and is connected to a conduit or other suitable means leading to a source of high pressure gas (not shown).

Figure 3:
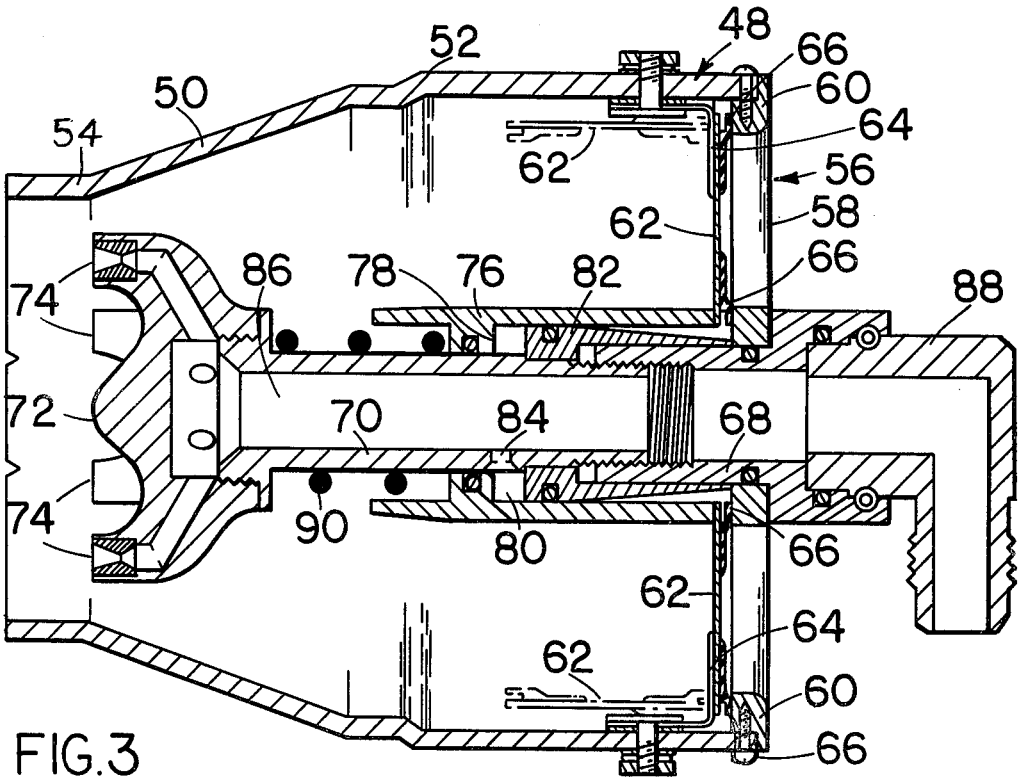
FIG. 3 is an enlarged diametrical sectional view of the aspirator for inflating the escape slide, taken along line 3—3 in FIG. 1, showing the flapper valve with the flapper plates in the closed position in full lines and with the flapper plates being shown in the open position in dot-dash lines.

A spring means such as a coil spring 90 is positioned around the cylindrical member 70 between the nozzle assembly 72 and the annular projection 78 for urging the locking sleeve 76 towards the flange 60 to hold the flapper plates 62 in the closed position as during the packing operation. The spring 90 exerts enough force so that a ten-foot head of water exerting pressure against the flapper plates 62 will not move them into the open position. When the slide 12 is being inflated, the high pressure gas in the gas transfer chamber 86 is communicated to the annular chamber 80 and causes the locking sleeve 76 to move to the left, as shown in FIG. 3, overcoming the pressure of the coil spring 90 and permitting the flapper plates 62 to move to the open position.

During the packing operation, the vacuum pump 16 provides a vacuum of from twenty-five to twenty-eight inches of mercury which is needed to obtain sufficient air flow out of the slide 12 to deflate it in a reasonable period of time of from a few minutes to one-half hour with a vacuum line 18 of about one-half inch in diameter. Preferably the desired vacuum for packing is from two inches to five inches and it has been found that when the vacuum is greater than four inches of mercury, it is difficult to properly fold the slide 12 and the sealing lip 66 may be distorted causing a defective seal after the slide 12 is inflated and the flapper plates 62 returned to the sealing position. With the packing system of this invention, the spring 36 of the vacuum limiter 20 is placed under compression by the screw 34 in an amount so that when the vacuum in the vacuum line 18 exceeds four inches of mercury, the ambient pressure will move the ball 32 away from the valve seat 30 and permit air at atmospheric pressure into the escape slide 12 through the bore 24 and vacuum line 18 to reduce the vacuum in the aspirator 48. In this way, the maximum vacuum applied during the packing process is limited to not over four inches of mercury. This condition is maintained while the aircraft escape slide 12 is being folded and packed into the limited space required and protects the sealing lips 66 of the flapper plate 62 in valve assembly 56 from being distorted. Thereafter the vacuum opening 14 is closed and the escape slide 12 is put into position for operation with the aspirator 48 connected to a suitable source of high pressure gas.

Several and various modifications of the present embodiment will be evident to those skilled in the art and such modifications are understood to fall within the scope of the invention as set forth in the appended claims.

We claim:

1. A packing system for an inflatable, foldable container comprising an aspirator for inflating said container, said aspirator having an inlet open to the atmosphere during operation of said aspirator, valve means to close said inlet when said aspirator is not operable, vacuum means in communication with said valve means in said inlet providing a first predetermined vacuum for removing a gaseous medium from said container at a sufficient flow to deflate said container in a reasonable period of time and vacuum control means responsive to the difference in pressure in said container and atmospheric pressure in communication with said vacuum means for admitting air at atmospheric pressure into said container at a second predetermined vacuum substantially less than said first predetermined vacuum to facilitate packing of the container in a limited space.

2. A packing system according to claim 1 wherein said valve means includes an inlet plate with a flapper plate, said flapper plate having a sealing member engageable with a flange member of said inlet plate in the closed position of said valve, and spring means for urging said flapper plate into the closed position with said sealing member pressed against said flange member.

3. A packing system according to claim 2 wherein said spring means for urging said flapper plate into the closed position is released in response to a reduction in pressure of the high pressure inflating gas passing through said aspirator.

* * * * *